US006695472B1

(12) United States Patent
Nayer

(10) Patent No.: US 6,695,472 B1
(45) Date of Patent: Feb. 24, 2004

(54) DEVICE FOR MEASURING THE TEMPERATURES OF AXLES OR BEARINGS FOR LOCATING HOT-BOXES OR OVERHEATED BRAKES IN ROLLING STOCK

(75) Inventor: Wolfgang Nayer, Zeltweg (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 10/110,856

(22) PCT Filed: Oct. 9, 2000

(86) PCT No.: PCT/AT00/00262

§ 371 (c)(1),
(2), (4) Date: Apr. 18, 2002

(87) PCT Pub. No.: WO01/28838

PCT Pub. Date: Apr. 26, 2001

(30) Foreign Application Priority Data

Oct. 19, 1999 (AT) ..... 1769/99

(51) Int. Cl.[7] ..... G01J 5/08; G01J 5/32

(52) U.S. Cl. ..... 374/141; 374/121; 250/338.1; 250/342

(58) Field of Search ..... 374/141, 121, 374/130, 132, 153; 250/342, 339.14, 339.11, 339.02, 338.1, 341.1; 385/12

(56) References Cited

U.S. PATENT DOCUMENTS 3,646,343 A * 2/1972 Caulier et al.
3,816,741 A * 6/1974 Macall ..... 250/347
3,998,549 A * 12/1976 Pusch et al.
4,015,476 A * 4/1977 Roche et al.
4,538,181 A * 8/1985 Taylor
4,600,837 A * 7/1986 DiStefano et al.
4,659,043 A * 4/1987 Gallagher
5,149,969 A * 9/1992 Fouilloy et al. ..... 250/334
5,397,900 A 3/1995 Wetzler
5,401,979 A * 3/1995 Kooijman et al. ..... 250/561
5,478,151 A 12/1995 Duhrkoop
5,552,592 A * 9/1996 Dvorkis et al. ..... 235/462
5,565,983 A * 10/1996 Barnard ..... 356/328
5,660,470 A * 8/1997 Mench
5,671,047 A * 9/1997 Curbedo ..... 356/346
5,831,762 A * 11/1998 Baker et al. ..... 359/353
6,286,992 B1 * 9/2001 Kyrtsos
6,419,387 B1 * 7/2002 Legrandjacques et al. ..... 374/5
6,461,035 B2 * 10/2002 Meinlschmidt et al. ..... 374/5
6,515,781 B2 * 2/2003 Lewis et al. ..... 359/204

FOREIGN PATENT DOCUMENTS

AT 390 928 B 7/1990 ..... B61K/9/06
EP 0 263 896 B1 9/1990 ..... B61K/9/06

* cited by examiner

*Primary Examiner*—Gail Verbitsky
(74) *Attorney, Agent, or Firm*—Chapman and Cutler LLP

(57) ABSTRACT

In a device for measuring the temperatures of axles and/or bearings to locate hot-boxes or overheated brakes in rolling stock, in which the infrared rays of the measuring points are directed onto an infrared receiver (8) via an oscillating mirror (9), whereby infrared rays emitted transversely to the longitudinal direction of the rails are detected in the scanning plane defined by the oscillation of the oscillating mirror (9), at least two deviation mirrors (1, 2) are arranged within the scanning plane at a distance (a) from one another transverse to the longitudinal direction of the rails. The deviated infrared rays of the deviation mirrors (1, 2) are detected in a chronological sequence in accordance with the oscillation of the oscillating mirror (9).

20 Claims, 2 Drawing Sheets

Figure 1:
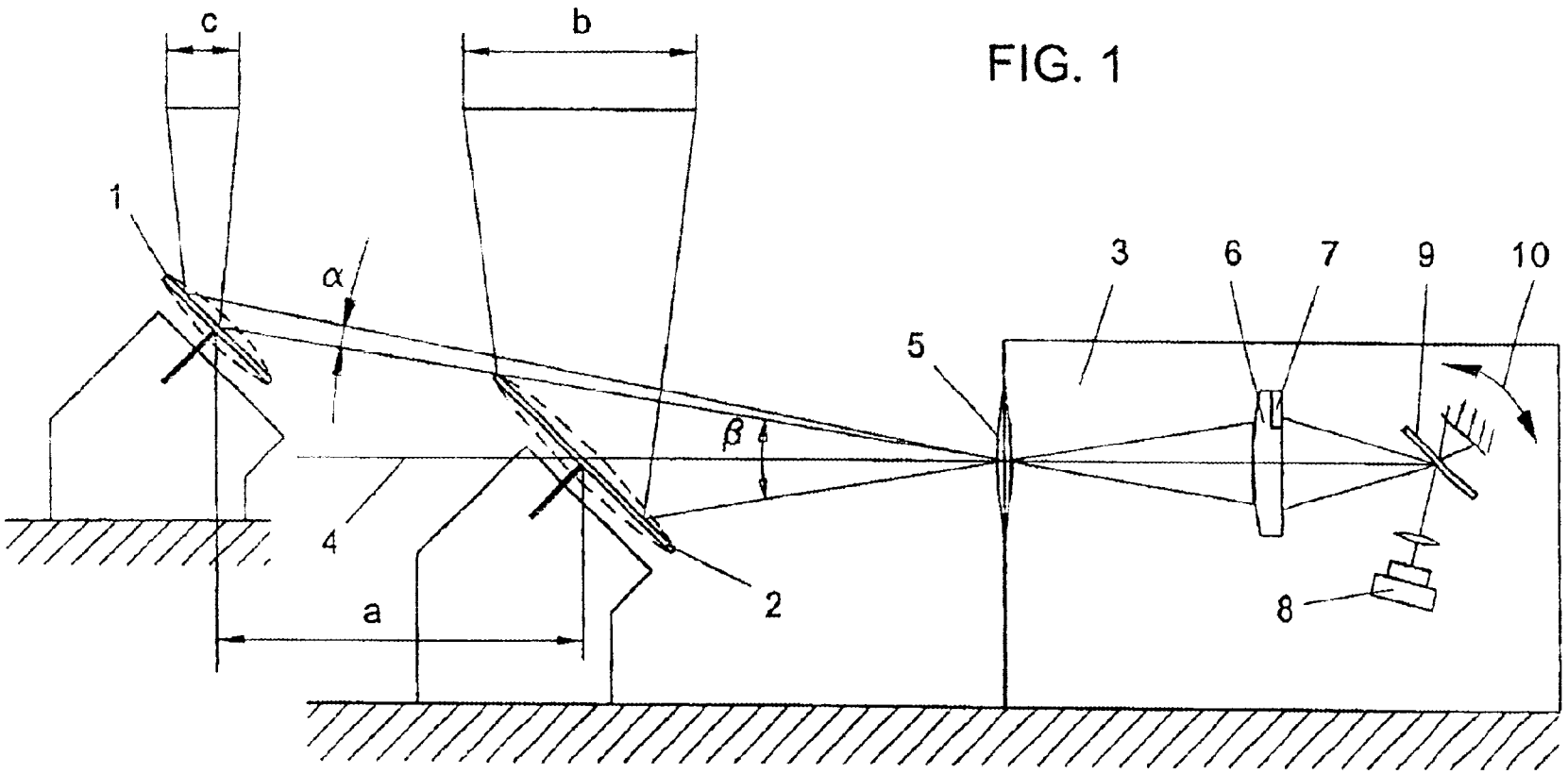

DEVICE FOR MEASURING THE TEMPERATURES OF AXLES OR BEARINGS FOR LOCATING HOT-BOXES OR OVERHEATED BRAKES IN ROLLING STOCK

The invention relates to a device for measuring the temperatures of axles and/or bearings to locate hot-boxes or overheated brakes in rolling stock, in which the infrared rays of the measuring points are directed onto an infrared receiver via an oscillating mirror, whereby infrared rays emitted transversely to the longitudinal direction of the rails are detected in the scanning plane defined by the oscillation of the oscillating mirror.

Devices of the initially defined kind are described, for instance, in AT 395 571 B or AT 398 413 B. Such devices are also referred to as hot-box locating devices, wherein it is feasible as a function of the measuring region detected, to detect also blocking brakes or other inadmissibly heated parts of railway vehicles by the aid of analogous devices. As detection means, devices of that type would use thermal detectors such as, for instance, bolometers or also rapidly responding thermal radiation probes such as, for instance, HgCd, HgTe, InSb, PbSe or combinations of such semiconductors. Such semiconductors react to alterations by the thermal excitation of free charge carriers and are able to resolve high pulse repetition radiation, yet are unsuitable for the continuous detection of a given temperature level without additional means such as, for instance, modulators or deviation means, by which the incident ray is cyclically interrupted or directed onto other temperature levels.

Such devices, as a rule, are arranged in the track region with the measuring ray reaching the generally cooled detector through a window of the device and appropriate deviation means. The arrangement usually is realized such that the active window is able to detect the bearings of a rolling railway vehicle while enclosing an angle to the normal. In order to avoid measuring inaccuracies and, in particular, a running error caused by what is called a sinusoidal run, a number of special evaluation methods has been developed, which enable the actual detection of the respectively hottest point of an axle or bearing transverse to the longitudinal direction of the rails, such a special measuring and evaluation method being described, for instance, in AT 398 413 B.

A disadvantage common to all of the hitherto known devices consists in that strongly differing track wheel dimensions and, in particular, differing track wheel dimensions of coaches or freight cars and, above all, so called low-platform cars substantially influence the possible scanning range derived from the distance of the oscillating mirror to the scanning surface. Due to the geometry of different vehicles and, in particular, the geometry of different bearings, it is usually only very difficult to detect several scanning surfaces simultaneously at different sets of coaches by just a single device.

The invention aims to provide a simple device of the initially defined kind, which includes a scanning-plane detecting oscillating mirror and by which it is feasible, irrespective of the geometry of the respectively rolling vehicle, to detect defined positions in the region of the axles and, in particular, bearing axles, brakes such as, for instance, disc brakes, or any other possibly inadmissibly heated parts of a vehicle and to obtain complete information by the aid of a single detection device. To solve this object, the device according to the invention essentially consists in that at least two deviation mirrors are arranged within the scanning plane at a distance from one another transverse to the longitudinal direction of the rails, whose deviated infrared rays are detected in a chronological sequence in accordance with the oscillation of the oscillating mirror. Due to the fact that at least two deviating mirrors are arranged within the scanning plane at a distance from each other transverse to the longitudinal direction of the rails, a plurality of measuring regions or measuring points can be deviated into a scanning plane defined in correspondence with the oscillation of the oscillating mirror, and conducted to a common detector if the deviation mirrors respectively associated with the individual measuring points are arranged in a laterally spaced-apart relationship and the deviated infrared rays are directed during scanning onto the infrared detector in a chronological sequence based on the oscillation of the oscillating mirror.

In a particularly advantageous manner, the configuration according to the invention is devised such that the deviation mirrors are designed as deviation mirrors rotating about an axis extending normal to the mirror plane. Such rotating deviation mirrors at accordingly high rotational speeds due to the centrifugal force are able to throw off dust particles impinging on the mirror surfaces such that a self-cleaning effect of the deviation mirrors is observed.

Advantageously, the configuration may be devised in a manner that the planes of the mirror surfaces of the deviation mirrors are arranged substantially parallel with one another. If such mirror surfaces of the deviation mirrors are arranged substantially parallel with one another, a plurality of superimposed positions may each be associated to such a deviation mirror, and reliably detected one after the other, within the scanning plane defined by the respective oscillation mirror, thus enabling a particularly simple compensation of superimposed signals at the transition from one deviation mirror to the consecutive deviation mirror within the range of oscillation of the oscillating mirror.

In a particularly simple manner, the configuration is devised such that the deviation mirrors are arranged in different heights, or at different vertical distances relative, to the rolling plane or relative to the plane stretched by the rail sleepers, respectively. With a substantially parallel arrangement of the planes of the mirror surfaces of the deviation mirrors, such a shift transverse to the longitudinal direction of the rails, or in the longitudinal direction of the axis of the sleeper, results in the detection of precise positions of an axle or bearing without requiring the inclination of the optical axis of the detector in a manner likely to be affected by different geometric configurations of vehicle bogies. This applies, in particular, to a substantially horizontal arrangement of the optical axis of the input optics of the detector, which is preferred.

Advantageously, the configuration according to the invention is devised such that the rotating deviation mirrors are arranged within a hollow sleeper and that the sleeper, in the vertical direction above the respective mirror, comprises openings or windows for the passage of infrared rays. It is, thus, feasible to arrange the rotating deviation mirrors themselves in a protected manner and to safely detect a plurality of measuring points or measuring regions within the scanning plane defined by the mirror oscillation, at a narrowly defined scanning angle that will not be disturbed by foreign influences. The openings or windows of the sleeper may suitably be protected by infrared-permeable glasses or even by screens or slides so as to substantially reduce any risk of contamination of the mirrors.

Advantageously, the configuration is devised such that the optical axis of the entrance lens of the detector comprising the oscillating mirror and the infrared receiver extends substantially parallel with the running plane. Such an orientation of the optical axis of the optics of the detector and, in particular, of the optical axis of the entrance lens of the detector allows for the protected arrangement of the detector itself, for instance within a hollow sleeper, in order to further reduce adverse effects by mechanical influences or contamination. This configuration, in particular, renders feasible to safeguard that the measuring ray will in no way be interrupted even in the event of low-platform cars or parts hanging from cars, so as to safely provide the necessary measuring values for all axles.

Advantageously, the configuration is devised such that the planes of the deviation mirrors are arranged to be inclined relative to the running plane by approximately 45°, the optical axis of the entrance lens of the detector preferably being axially or axially parallelly arranged within the hollow sleeper in the longitudinal direction of the sleeper. The precise allocation to measuring regions or measuring points each arranged to be offset in the longitudinal direction of the axes such as, for instance, bearings or disc brakes in this case advantageously is rendered feasible in that the deflection mirrors are each arranged below the measuring points to be detected, whereby a particularly high measuring accuracy will be ensured if the rotating deviation mirrors are arranged within the vertical projection of the respective measuring surface. In this manner, the total measuring surface within the oscillation range of the oscillating mirror is each scanned so as to provide complete information on the axial width of the region being measured.

According to a preferred configuration of the hot-box locating device according to the invention, the deviation mirrors are designed as convex or concave deviation mirrors. When using a convex mirror, the scanning range will be enlarged, and when using a concave mirror, the scanning range will be reduced.

In the following, the invention will be explained in more detail by way of an exemplary embodiment schematically illustrated in the drawing. Therein, FIG. 1 shows the schematic arrangement of two rotating deviation mirrors relative to a detector comprising an oscillating mirror, and FIG. 2 shows the schematic arrangement of the device in the interior of a hollow measuring sleeper.

FIG. 1 depicts two rotating deviation mirrors 1 and 2 arranged to be offset by a distance a in the axial direction of a sleeper, the detector 3 being arranged at an axial distance from the two rotating deviation mirrors 1 and 2 with a substantially horizontal axis 4 of the entrance optics or entrance lens 5. The axis 4 designates the central ray that reaches a field lens 6 via the focussing optical element, i.e., the entrance lens 5. By 7, an autocollimation element is denoted, at which the temperature of the infrared detector 8 is reflected on itself, provided an appropriate oscillation position of the oscillating mirror 9, so that a reference value will be obtained. The oscillating mirror 9 oscillates in the sense of double arrow 10, thus stretching a scanning plane that extends in the drawing plane and initially effecting a first partial scan over a zone b via the deviation mirror 2 during the oscillating movement of the oscillating mirror 9 and, after this, a further partial scan over an axial length c using the deviation mirror 1, whereby the respective measuring jets extending in said plane are detected by the detector 8 in a chronological sequence through the angular spreads __ and __. It goes without saying that a further rotating mirror, which is not illustrated, enables the scanning of further measuring sites such as, for instance, a disc brake. The deviation mirrors 1 and 2 may comprise plane mirrors as indicated in FIG. 1 by broken lines, convex or concave mirrors.

Figure 2:
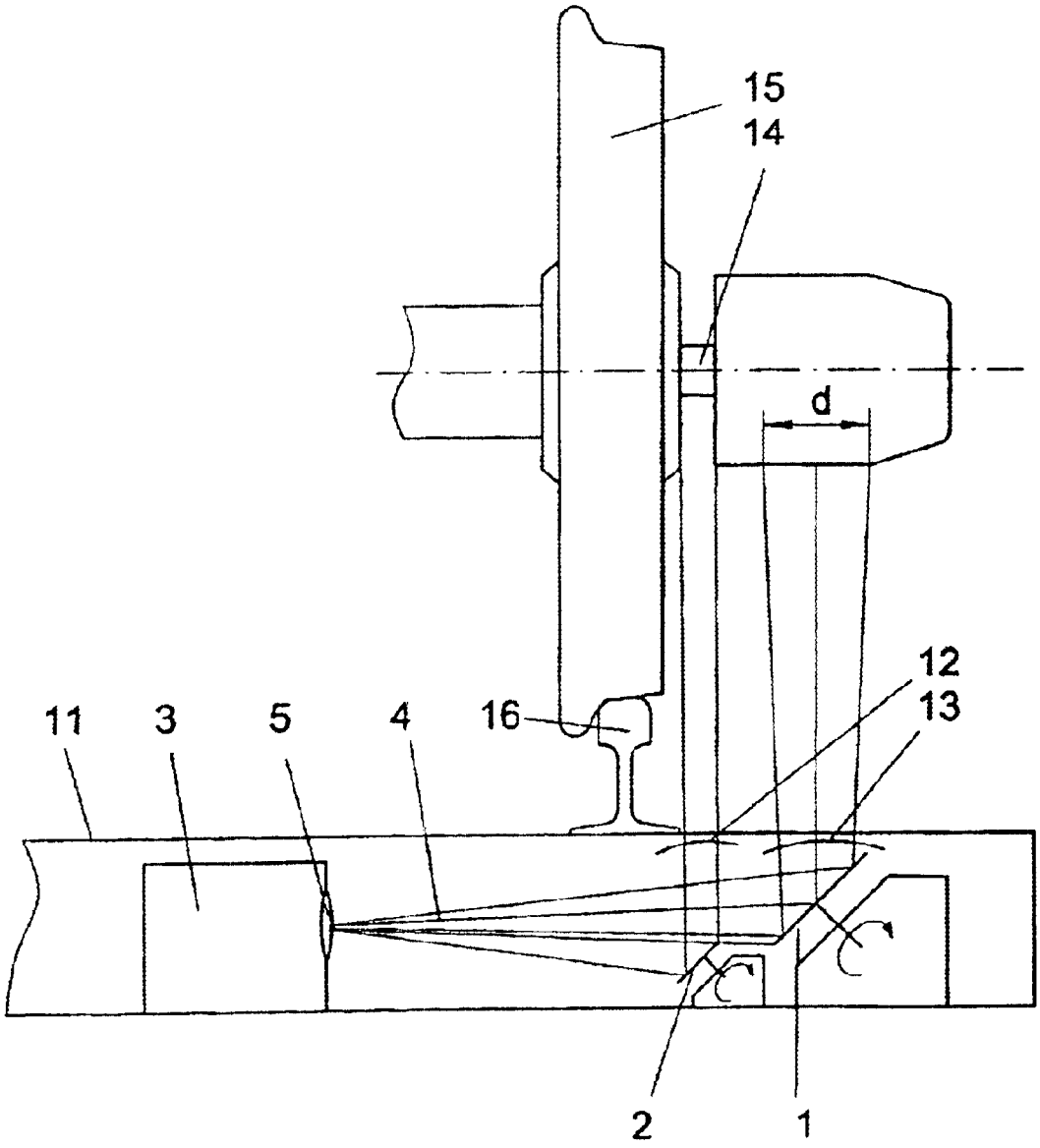

In the illustration according to FIG. 2, the detector 3 and the two rotating mirrors 1 and 2 are arranged in the interior of a hollow measuring sleeper 11, the optical axis 4 substantially coinciding with the longitudinal axis of the measuring sleeper 11. The measuring sleeper includes windows 12 and 13, through which the infrared rays departing from the respective partial region to be measured can reach the deviation mirrors 1 and 2 and which windows 12 and 13 may be closed by slides. In the illustration according to FIG. 2, the measuring jet entering through window 13 is oriented in a manner that a partial region d of a bearing can be detected in the direction of the axis of the bearing and the respective temperature measuring values can be detected by the detector over this partial region d. The partial region located above the measuring window 12 in the instant case constitutes a partial region of the axis 14 of a rail vehicle whose track wheel is denoted by 15. The rail itself is schematically indicated by 16 and fixed to the sleeper transverse to the longitudinal axis of the sleeper.

The windows 12 and 13 as well as optionally additional windows may each be arranged vertically below the zone to be measured whereby the axial central ray of the measuring device itself, i.e. the optical axis of the focussing optical element 5, may extend in a protected manner in the interior of the sleeper substantially horizontally without the ray being interrupted either by different configurations of bogies and different dimensions of wheels and bearings or by parts of a vehicle hanging from the same.

What is claimed is:

1. A device for measuring temperatures of parts of rolling stock on rails to locate hot-boxes or overheated parts of the rolling stock, comprising an infrared receiver (8) for measuring infrared rays, onto which infrared rays emitted within measuring points (b, c) are directed;

an oscillating mirror (9) arranged to direct the infrared rays onto the infrared receiver (8), so that infrared rays emitted transversely to the longitudinal direction of the rails (16) are detected by the infrared receiver (8) in a scanning plane defined by the oscillation of the oscillating mirror (9), and at least two deviation mirrors (1, 2) arranged within the scanning plane at a distance (a) from one another, transverse to the longitudinal direction of the rails (16), so as to direct the infrared rays to said oscillating mirror (9), allowing the infrared receiver (8) to detect the infrared rays in a chronological sequence in accordance with the oscillation of the oscillating mirror (9).

2. The device of claim 1, wherein each of the deviation mirrors (1, 2) rotates around an axis extending normal to a plane of a mirror surface of the deviation mirror (1, 2).

3. The device of claim 1, wherein planes of mirror surfaces of the deviation mirrors (1, 2) are arranged substantially parallel with one another.

4. The device of claim 2, wherein planes of mirror surfaces of the deviation mirrors (1, 2) are arranged substantially parallel with one another.

5. The device of claim 1, wherein the deviation mirrors (1, 2) are arranged at different vertical distances relative to a plane defined by a base of the rolling stock.

6. The device of claim 1, wherein the deviation mirrors (1, 2) are arranged at different vertical distances relative to a plane defined by tops of rail sleepers supporting the rails (16).

7. The device of claim 1, wherein the deviation mirrors (1, 2) are arranged within a hollow rail sleeper (11), and wherein the hollow rail sleeper (11) has openings (12, 13)

arranged in the vertical direction above the deviation mirrors (1, 2) for passage of infrared rays.

8. The device of claim 1, wherein the oscillating mirror (9) and the infrared receiver (8) together comprise a detector (3) having an entrance lens (5), wherein the optical axis (4) of the entrance lens (5) of the detector (3) extends substantially parallel with a plane defined by the a base of the rolling stock.

9. The device of claim 8, wherein planes of surfaces of the deviation mirrors (1, 2) are arranged to be inclined by approximately 45° relative to a plane defined by a base of the rolling stock.

10. The device of claim 8, wherein the optical axis (4) of the entrance lens (5) of the detector (3) is axially arranged within a hollow rail sleeper (11) in the longitudinal direction of the hollow rail sleeper.

11. The device of claim 8, wherein the optical axis (4) of the entrance lens (5) of the detector (3) is axially parallelly arranged within a hollow rail sleeper (11) in the longitudinal direction of the hollow rail sleeper.

12. The device of claim 9, wherein the optical axis (4) of the entrance lens (5) of the detector (3) is axially arranged within a hollow rail sleeper (11) in the longitudinal direction of the hollow rail sleeper.

13. The device of claim 9, wherein the optical axis (4) of the entrance lens (5) of the detector (3) is axially parallelly arranged within a hollow rail sleeper (11) in the longitudinal direction of the hollow rail sleeper.

14. The device of claim 1, wherein the deviation mirrors (1, 2) are each arranged below the measuring points (b, c).

15. The device of claim 2, wherein the deviation mirrors (1, 2) are each arranged below the measuring points (b, c).

16. The device of claim 1, wherein the deviation mirrors (1, 2) are arranged within the vertical projection of the measuring points (b, c).

17. The device of claim 2, wherein the deviation mirrors (1, 2) are arranged within the vertical projection of the measuring points (b, c).

18. The device of claim 1, wherein the deviation mirrors (1, 2) are convex deviation mirrors.

19. The device of claim 1, wherein the deviation mirrors (1, 2) are concave deviation mirrors.

20. A device for measuring temperatures of parts of rolling stock to locate hot-boxes or overheated parts of the rolling stock, comprising an infrared receiver (8) for measuring infrared rays onto which infrared rays emitted within measuring points (b, c) are directed;

an oscillating mirror (9) arranged to direct the infrared rays onto the infrared receiver (8), so that infrared rays emitted transversely to the longitudinal direction of the rails (16) are detected by the infrared receiver (8) in a scanning plane defined by the oscillation of the oscillating mirror (9); and at least two deviation mirrors (1, 2) arranged within the scanning plane at a distance (a) from one another, transverse to the longitudinal direction of the rails (16), so as to direct the infrared rays to the oscillating mirror (9), allowing the infrared receiver (8) to detect the infrared rays in a chronological sequence in accordance with the oscillation of the oscillating mirror (9); and wherein each of the deviation mirrors (1, 2) rotates around an axis extending normal to a plane of a mirror surface of the deviation mirror (1, 2);

the deviation mirrors (1, 2) are arranged at different vertical distances relative to a plane defined by a base of the rolling stock;

the deviation mirrors (1, 2) are arranged within a hollow rail sleeper (11);

the hollow rail sleeper (11) has openings (12, 13) arranged in the vertical direction above the deviation mirrors (1, 2) for passage of infrared rays;

the oscillating mirror (9) and the infrared receiver (8) together comprise a detector (3) having an entrance lens (5), wherein the optical axis (4) of the entrance lens (5) of the detector (3) extends substantially parallel with a plane defined by the base of the rolling stock;

the planes of surfaces of the deviation mirrors (1, 2) are arranged to be inclined by approximately 45° relative to a plane defined by the base of the rolling stock; and the deviation mirrors (1, 2) are each arranged below the measuring points (b, c).

* * * * *